US005351349A

United States Patent [19]

Tsai et al.

[11] Patent Number: 5,351,349

[45] Date of Patent: Oct. 4, 1994

[54] MULTIPURPOSE SICKBED

[76] Inventors: Liang-Chieg Tsai, 5F, No. 442, Wu Hsing Street; Henry Tsung, No. 3, Lane 486, Section 1, Tung-Hua Street, Peitou, both of Taipei, Taiwan

[21] Appl. No.: 159,296

[22] Filed: Nov. 30, 1993

[51] Int. Cl.[5] ..... A61G 7/02

[52] U.S. Cl. ..... 5/604; 5/928; 5/463

[58] Field of Search ..... 5/604, 463, 928, 933

[56] References Cited

U.S. PATENT DOCUMENTS

| | | | |
|---|---|---|---|
| 2,872,689 | 2/1959 | Fournet | 5/604 |
| 3,757,355 | 9/1973 | Allen et al. | 5/604 |
| 3,943,583 | 3/1976 | Ishikawa | 5/463 X |
| 4,007,501 | 2/1977 | Kato | 5/604 |
| 4,030,149 | 6/1977 | Kato | 5/604 |
| 4,571,759 | 2/1986 | Sasaki et al. | 5/604 |
| 4,677,700 | 7/1987 | Su | 5/604 |
| 5,077,845 | 1/1992 | Tokunaga et al. | 5/463 X |

*Primary Examiner*—Michael F. Trettel

*Attorney, Agent, or Firm*—Morton J. Rosenberg; David I. Klein

[57] ABSTRACT

A multipurpose sickbed which includes an excretion collector mounted around an opening on an intermediate bed plate thereof for collecting waste excreted from the body of the patient as the patient is turned to a sitting position by a hydraulic cylinder, a water supply system controlled to spray warm water for cleaning the pubes and anus of the patient and cold water for cleaning the excretion collector after the act of excreting, an air dryer controlled to dry the pubes and anus of the patient after the cleaning process, massagers mounted on a front bed plate of the bed body and controlled to massage the patient, a cover board controlled by a hydraulic cylinder and a linkage and a lifting mechanism to close up the opening on the intermediate bed plate after the act of excreting.

3 Claims, 5 Drawing Sheets

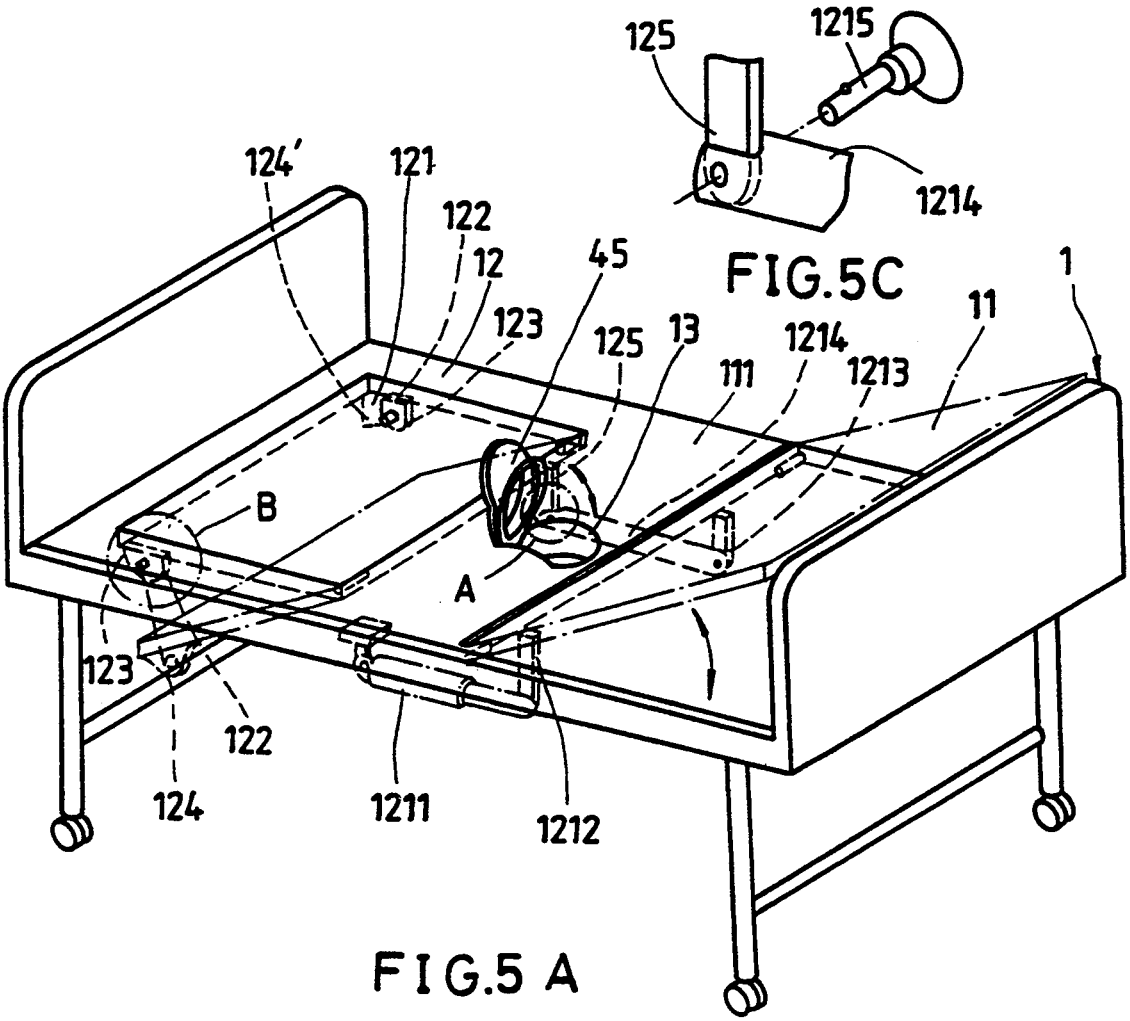
FIG.5C
FIG.5 A
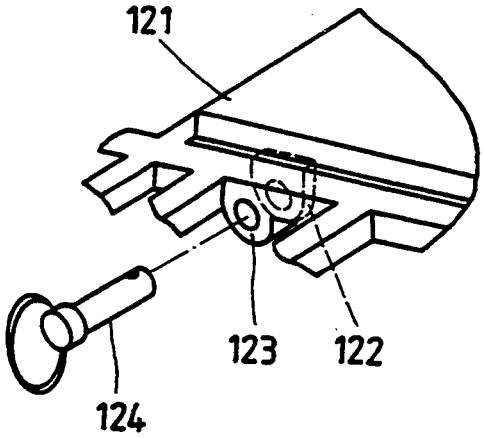
FIG.5D

MULTIPURPOSE SICKBED

BACKGROUND OF THE INVENTION

The present invention relates to a multipurpose sickbed which includes an excretion col lector mounted around an opening on an intermediate bed plate for collecting waste excreted from the body of the patient, a water supply system controlled to clean the pubes and anus of the patient after the excretion, an air dryer controlled to dry the pubes and anus of the patient after the cleaning process, and massagers mounted on a front bed plate and controlled to massage the patient.

A conventional sickbed is designed simply for a sick person to lie on. The bed plate of a conventional sickbed is commonly made foldable so that it can be turned to support the patient in a sitting position or to lift the upper part of the body. While taking care of a paralyzed sick person, the body of the patient must be frequently turned from side to side and properly massaged so as to prevent the skin from being affected with an ulcer. Furthermore, it is not an easy job to help a paralyzed sick person excrete waste and to clean the seat of the body of the paralyzed sick person after each discharge.

SUMMARY OF THE INVENTION

The present invention has been accomplished under the aforesaid circumstances. It is therefore an object of the present invention to provide a sickbed which can be conveniently controlled through a control panel to turn the bed plates thereof in lifting the patient into a sitting position. It is another object of the present invention to provide a sickbed which allows the patient to excrete waste from the body when the patient is lifted by the bed plates thereof to a sitting position on an opening above an excrete collector. It is still another object of the present invention to provide a sickbed which is controlled to automatically clean the pubes and anus of the patient after the act of excreting. It is still another object of the present invention to provide a sickbed which comprises an air dryer controlled to automatically dry the pubes and anus of the patient after the process of cleaning. It is still another object of the present invention to provide a sickbed which comprises massagers controlled to automatically massage the patient lying thereon.

BRIEF DESCRIPTION OF THE DRAWINGS

FIG. 5A is a perspective view of the alternate form of FIG. 5; and

FIG. 5C is a perspective partially cut-away view of a link for displacing a front bed plate; and, FIG. 5D is a perspective partially cut-away view of a fastener for securing the movable bed board to the bed body.

DETAILED DESCRIPTION OF THE PREFERRED EMBODIMENTS

Figure 1:
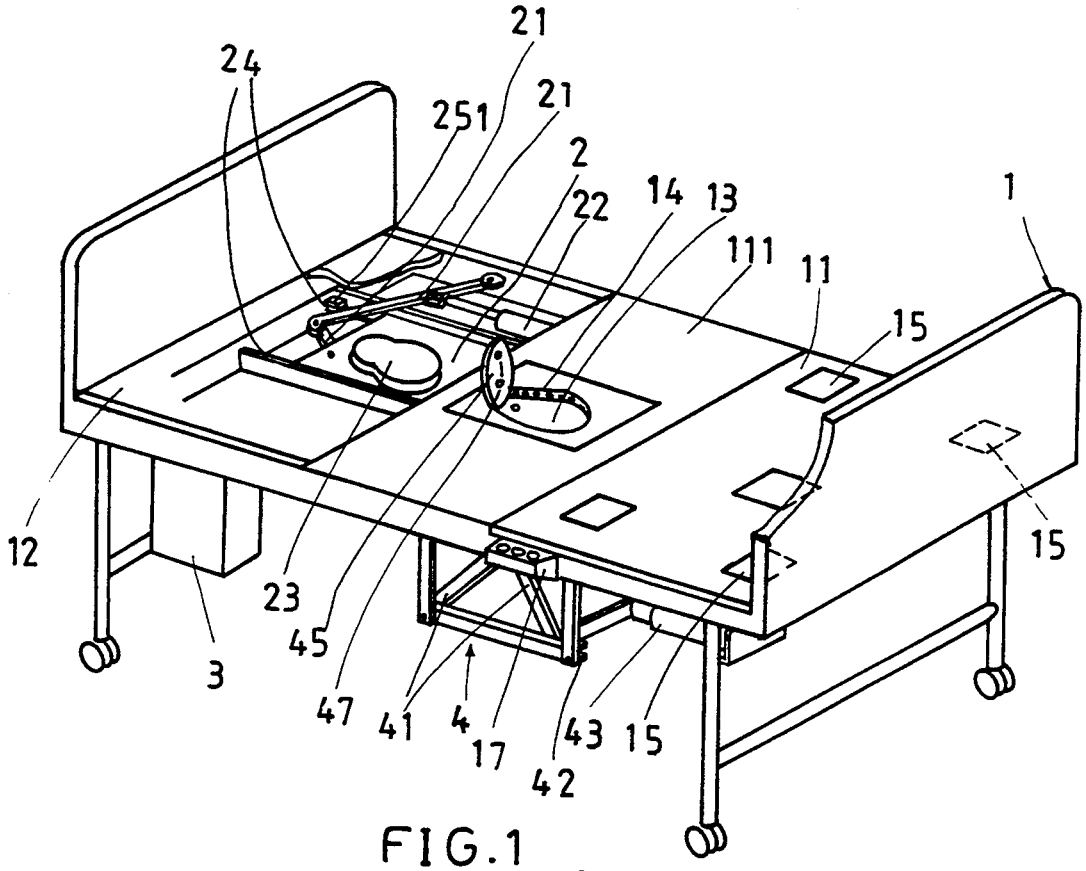
FIG. 1 is a cutaway of a multipurpose sickbed according to one embodiment of the present invention.
Figure 2:
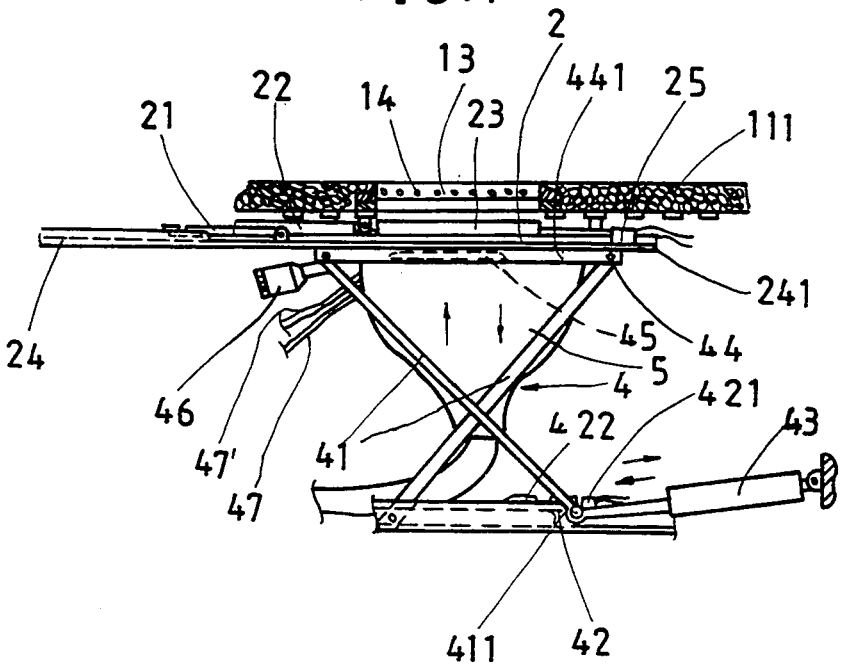
FIG. 2 is a side sectional view of the multipurpose sickbed of FIG. 1 showing the block on the cover board removed from the opening on the intermediate bed plate.
Figure 3:
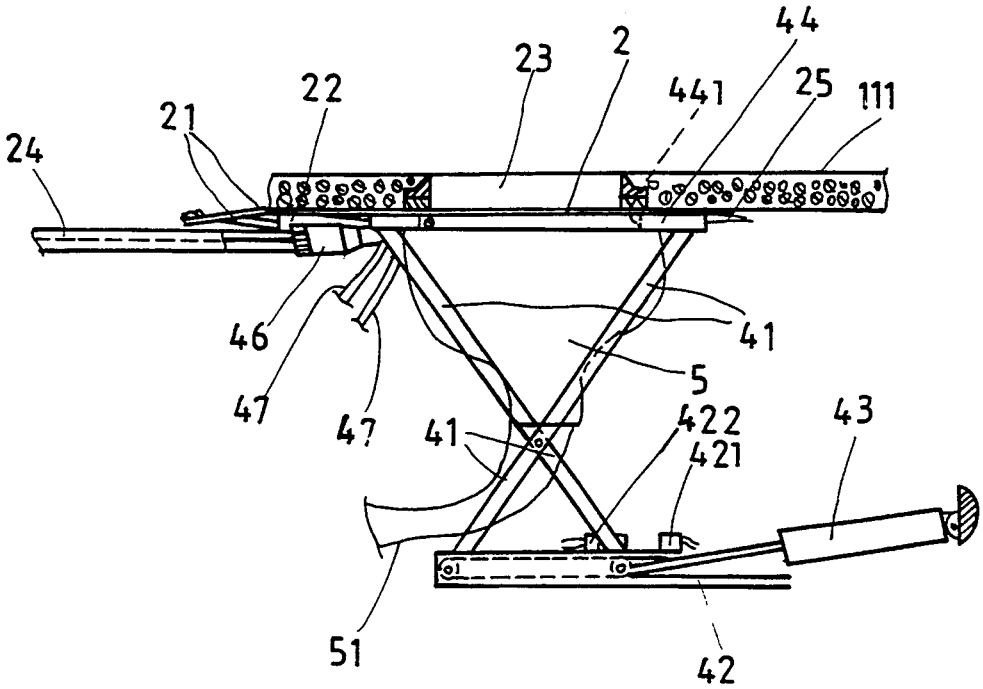
FIG. 3 is similar to FIG. 2 but showing the block on the cover board fitted into the opening on the intermediate bed plate.
Figure 4:
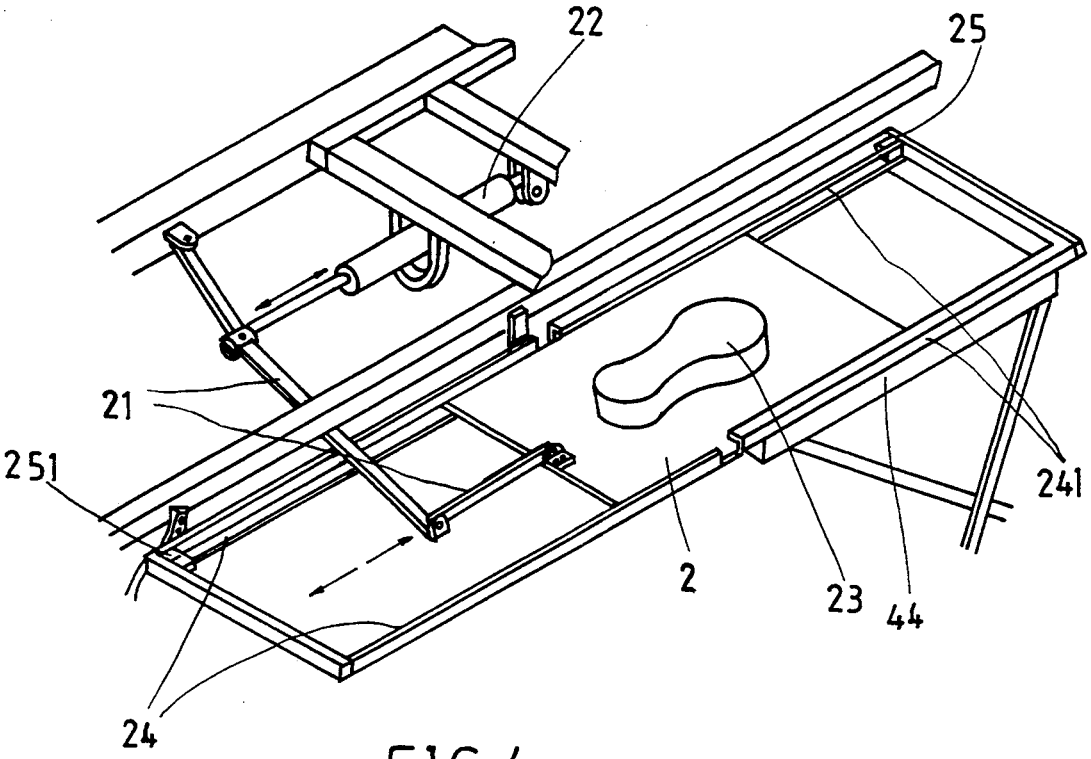
FIG. 4 shows the positioning of the cover board on the bed body.

Referring to FIGS. 1, 2, 3, and 4, the bed body 1 of the sickbed is comprised of a front bed plate 11, an intermediate bed plate 111, and a rear bed plate 12. A plurality of massagers 15 are mounted on the front bed plate 11 at suitable locations. An opening 13 is made on the intermediate bed plate 111 in the center. The opening 13 fits over the seat of the body so that the patient can sits on the opening 13 to discharge feces comfortably. A set of infrared inductors 14 are mounted around the opening 13. A lifting mechanism 4 is installed in the bed body 1 below the opening 13. The lifting mechanism 4 comprises a hydraulic cylinder 43, a track 42 at the bottom, an intersected rod assembly 41 driven by the hydraulic cylinder 43 to move on the track 42, a platform 44 supported on the intersected rod assembly 41. The platform 44 comprises two guide rails 241 bilaterally disposed at the top, an opening 441 aligned with the opening 13 on the intermediate bed plate 111, an excretion collector 5 mounted around the opening 441 at the bottom, and a stop board 45 hinged to the opening 441 at one side. The feces collector 5 is connected to a septic tank or the like by a pipe 51. The stop board 45 can be lifted from a horizontal position to a vertical position and covered over the pubes of the patient as the patient is discharging urine or feces through the openings 13;441 into the feces collector 5. After an excretion, the infrared inductors 14 are induced to drive a warm-/cold water supply system (not shown) causing it to spray warm water through a warm water outlet pipe 47' over the pubes and anus of the patient and cold water through a cold water outlet pipe 47 over the excretion collector 5, and therefore the pubes and anus of the patient as well as the excretion collector 5 are cleaned. After washing, an air dryer 46 which is mounted on the platform 44 at one side is immediately driven by a control circuit to produce a hot current of air toward the pubes and anus of the patient, and therefore the pubes and anus of the patient are quickly dried. After the process of drying, the massagers 15 are turned on to massage the patient (see FIG. 6).

After the completion of the aforesaid procedures, the platform 44 is lowered and then retained in position, and then a cover board 2 is moved along rails 24 by a hydraulic cylinder 22 via a linkage 21. As the cover board 2 touches a switch 25 at one end of the rails 24, the cover board 2 is stopped, and at the same time the lifting mechanism 4 is actuated to lift the platform 44 in moving the cover board 2 upward. When the cover board 2 is lifted by the platform 44, the block 23 which is mounted on the cover board 2 at the top is moved to fit into the opening 13 in flush with the intermediate bed plate 111. When to excrete waste from the body, the patient can control a control box 16 through a control panel 17 to lower the lifting mechanism 4. The control box 16 has a control circuit on the inside which control the operation of the sickbed. As the projecting block 411 which is mounted on the intersected rod assembly 41 at the bottom touches a respective switch 421, the lifting mechanism 4 is immediately stopped, and the cover board 2 is therefore moved to the rails 24 at one end. The hydraulic cylinder 22 is then operated to move the linkage 21 causing the cover board 2 moved from the opening 13 to the opposite end of the rails 24. As the cover board 2 touches another switch 251, it is immediately stopped, and at the same time the lifting mechanism 4 is actuated again to lift the platform 44 to the rear bed plate 12, and therefore the patient can then discharge waste through the opening 13. When the platform 44 is lifted to the rear bed plate 12, the projecting block 411 will touch another switch 422, causing the lifting mechanism 4 to stop the platform 44. Further, there is provided an oil pump 3 controlled by the control box 16 to operate the hydraulic cylinders 22;43.

Figure 5:
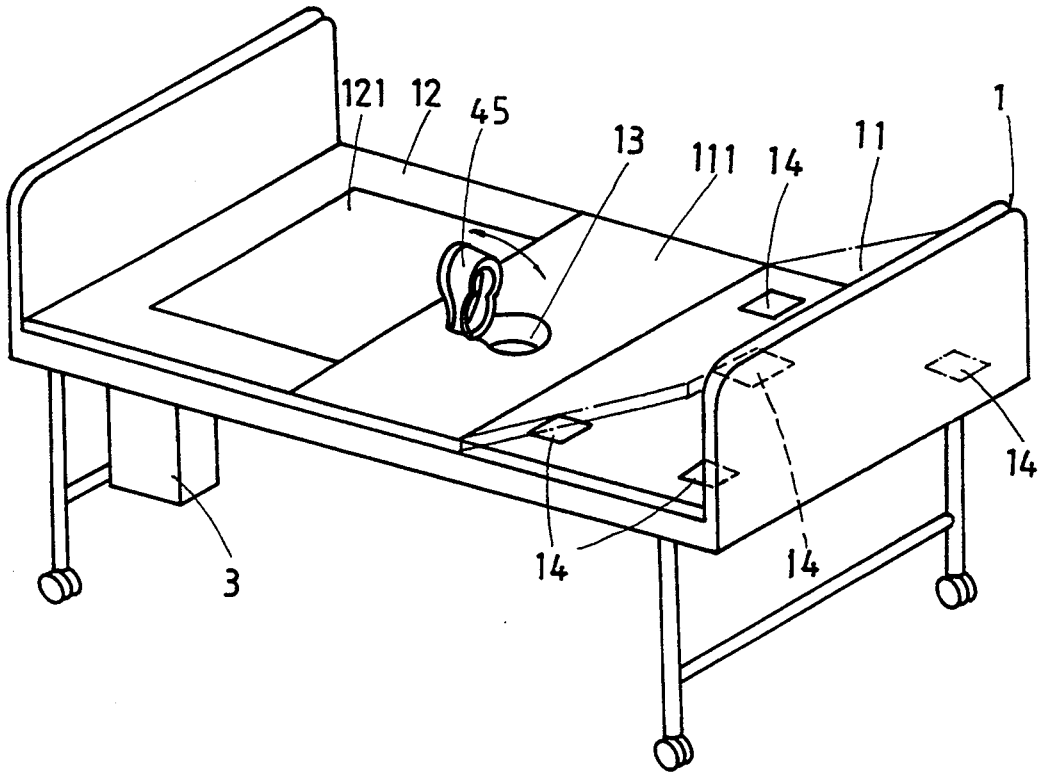
FIG. 5 shows an alternative form of the present invention.
Figure 5B:
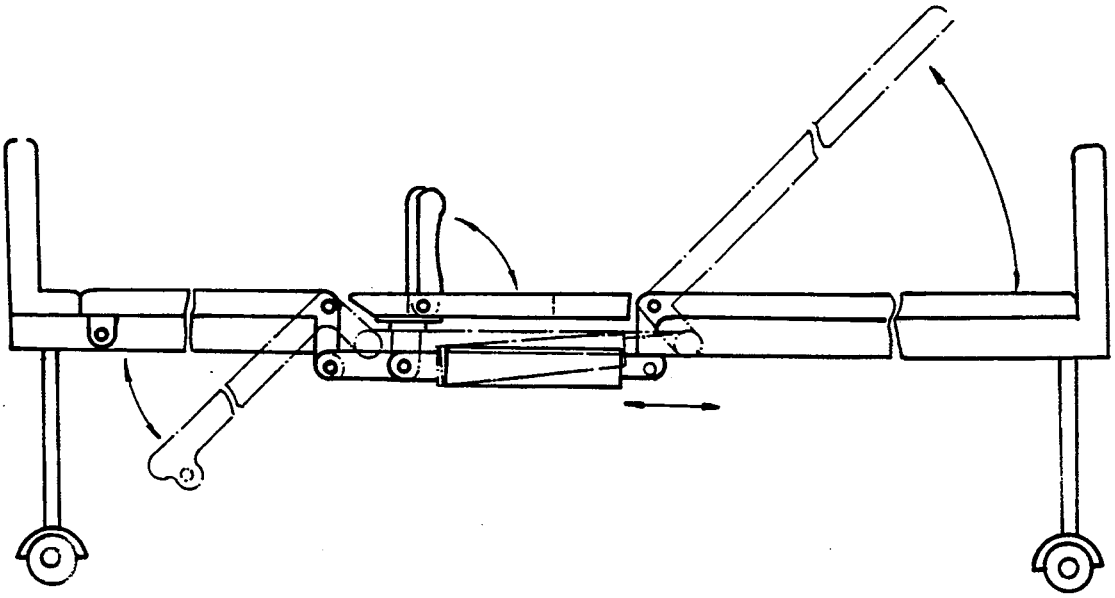
FIG. 5B is a side view showing the front bed plate and the movable board turned in different directions.

Referring to FIG. 5, the cover board 2 and the lifting mechanism 4 may be eliminated from the sickbed, when the sickbed is adapted for serving paralytics, and a stop board 35 can be directly hinged to the opening 13 at one end. According to this alternate form, a hydraulic cylinder 1211 is installed in the bed body 1 at the bottom at one side controlled to turn the front bed plate 11 on two pivot rods 1212;1213, and therefore the front bed plate 11 can be turned between a horizontal position and a upwards inclined position. There is a link 1214 having one end pivoted to the pivot rod 1213 and an opposite end pivoted to a pivot rod 125 on a movable board 121 by a pivot pin 1215. The movable board 121 is mounted within an opening (not shown) on the rear bed plate 12. As the front bed plate 11 is turned to the upwards inclined position, the movable board 121 is turned from a horizontal position to a downwards inclined position by the link 1214. Therefore, when the patient is going to discharge waste, the patient can lie on the bed body 1 with the upper body supported upward on the front bed plate 11 and the legs supported downward on the movable board 121. The movable board 121 further comprises two opposite lugs 122;122' on two opposite sides thereof corresponding to two opposite lugs on the bed body 1. By fastening the lugs 122;122' on the movable board 121 to the lugs 123;123' on the bed body 1, the movable board 121 is maintained in the horizontal position as the front bed plate 11 is turned from the horizontal position to the upwards inclined position.

What is claimed is:

1. A multipurpose sickbed comprising:

a bed body having a bed plate assembly consisting of a front bed plate, an intermediate bed plate, and a rare bed plate longitudinally connected in series, said front bed plate comprising a plurality of massagers, said intermediate bed plate comprising a center opening through which a patient may pass out waste matter from the body, a set of infrared inductors mounted around said center opening;

a lifting mechanism having a top section and a bottom section, said lifting mechanism installed in said bed body below said center opening, said lifting mechanism comprising a first hydraulic cylinder, a track located in the bottom section fastened to said bed body, a linkage driven by said first hydraulic cylinder to move on said track, a platform supported on an intersected rod assembly and moved by said intersected rod assembly toward or apart from said intermediate bed plate, said platform comprising two guide rails bilaterally disposed at the said top section of said lifting mechanism, an opening aligned with the center opening on said intermediate bed plate, an excretion collector mounted around the opening of said platform at a bottom surface thereof to collect waste matter passed from the body of the patient through the center opening of said intermediate bed plate, and a stop board hinged to the opening of said platform at one side for covering over the pubes of the patient as said platform is lifted;

a warm/cold water supply system controlled to spray warm water for cleaning the pubes of the patient through a water pipe being connected to said stop board and to spray cold water for cleaning said excretion collector through a cold water pipe;

an air dryer mounted on said platform at one side by the opening on said platform and controlled to produce a hot current of air toward the opening on said platform and the center opening on said intermediate bed plate to dry the pubes and anus of the patient after the act of excreting;

a cover board for covering the center opening on said intermediate bed plate;

a second hydraulic cylinder mounted on said bed body and controlled to move said cover board to said platform for permitting said cover board to be moved upward by said platform to cover the center opening on said intermediate bed plate; and a control circuit to control the operation of said infrared inductor, said warm/cold water supply system, said air dryer, said first hydraulic cylinder, and said second hydraulic cylinder.

2. The multipurpose sickbed of claim 1 further comprising a third hydraulic cylinder controlled to turn said front bed plate from a horizontal position to an upwards sloping position to lift the upper part of the patient being lying on the bed plate assembly.

3. The multipurpose sickbed of claim 2 wherein said front bed plate is linked to a movable board on an opening on said rear bed plate by a linkage, said movable board being turned from a horizontal position to a downwards sloping position by said linkage when said front bed plate is turned to said upwards sloping position.

* * * * *